US007765648B2

(12) United States Patent
Minter

(10) Patent No.: US 7,765,648 B2
(45) Date of Patent: Aug. 3, 2010

(54) APPARATUS FOR DETECTING A PARAMETER AT A PLURALITY OF SLIVERS FED TO A DRAFTING SYSTEM OF A SPINNING MACHINE

(75) Inventor: Franz-Josef Minter, Mönchengladbach (DE)

(73) Assignee: Truetzschler GmbH & Co. KG, Moenchengladbach (DE)

( * ) Notice: Subject to any disclaimer, the term of this patent is extended or adjusted under 35 U.S.C. 154(b) by 1055 days.

(21) Appl. No.: 11/485,378

(22) Filed: Jul. 13, 2006

(65) Prior Publication Data

US 2007/0028422 A1 Feb. 8, 2007

(30) Foreign Application Priority Data

Jul. 13, 2005 (DE) ..... 10 2005 033 180

(51) Int. Cl.
*D00H 5/32* (2006.01)

(52) U.S. Cl. ..... 19/239

(58) Field of Classification Search ..... 19/236–240, 19/250, 258, 98, 105, 300, 150, 157
See application file for complete search history.

(56) References Cited

U.S. PATENT DOCUMENTS 5,461,757 A 10/1995 Leifeld
5,544,390 A 8/1996 Hartung et al.
5,630,251 A 5/1997 Leifeld
5,673,462 A 10/1997 Leifeld
5,796,635 A 8/1998 Dammig
6,088,882 A 7/2000 Leifeld
6,189,879 B1 2/2001 Conner et al.
6,223,609 B1 5/2001 Leifeld et al.
6,289,599 B1 9/2001 Leifeld et al.
6,292,982 B1 9/2001 Breuer
6,336,256 B1 1/2002 Naf et al.
6,430,781 B1 8/2002 Breuer et al.

(Continued)

FOREIGN PATENT DOCUMENTS

CH 681899 A5 6/1993

(Continued)

OTHER PUBLICATIONS

British Search Report dated Dec. 13, 2006 issued in GB 0613865.5.

(Continued)

*Primary Examiner*—Tejash Patel
(74) *Attorney, Agent, or Firm*—Venable LLP; Robert Kinberg; Leigh D. Thelen

(57) ABSTRACT

In an apparatus for detecting a parameter at a plurality of slivers fed to a drafting system of a spinning machine, especially for detecting the movement and/or the presence of a sliver, in which the parameter is measurable separately at each sliver, each sliver is drawn out of sliver cans over a respective driven feed roller and fed to the drafting system and is mechanically sensed by a feeler element, the deflections of which are convertible into electrical signals. To allow an improved and more accurate detection of the individual slivers in a structurally simple manner, a distance sensor that is a contactless distance sensor is provided to detect the position of each feeler element, the sensor being connected to an electrical evaluating unit.

25 Claims, 3 Drawing Sheets

U.S. PATENT DOCUMENTS

| | | | | |
|---|---|---|---|---|
| 6,453,514 | B1 | 9/2002 | Breuer et al. | |
| 6,457,209 | B1 | 10/2002 | Breuer et al. | |
| 6,543,092 | B2 | 4/2003 | Breuer | |
| 6,874,204 | B2 * | 4/2005 | Dammig et al. | 19/236 |
| 7,103,440 | B2 * | 9/2006 | Dammig et al. | 700/143 |
| 2006/0260100 | A1 | 11/2006 | Duda et al. | |

FOREIGN PATENT DOCUMENTS

| | | | |
|---|---|---|---|
| DE | 904873 | | 3/1954 |
| DE | 7211136 | | 3/1972 |
| DE | 40 12 551 | C1 | 6/1991 |
| DE | 4106567 | A1 | 9/1991 |
| DE | 4125450 | A1 | 2/1993 |
| DE | 44 04 326 | A1 | 10/1994 |
| DE | 44 14 972 | C2 | 11/1995 |
| DE | 29511632 | | 11/1995 |
| DE | 195 00 189 | A1 | 7/1996 |
| DE | 19609781 | A1 | 10/1996 |
| DE | 19538496 | A1 | 2/1997 |
| DE | 195 43 229 | A1 | 5/1997 |
| DE | 198 19 728 | A1 | 3/1999 |
| DE | 298 23 928 | U1 | 3/2000 |
| DE | 199 08 371 | A1 | 8/2000 |
| DE | 10124433 | A1 | 11/2002 |
| EP | 0329081 | A1 | 8/1989 |
| FR | 2252550 | A1 | 6/1975 |
| FR | 2316173 | A1 | 1/1977 |
| FR | 2703446 | A1 | 10/1994 |
| FR | 2726292 | A1 | 5/1996 |
| FR | 2768437 | A1 | 3/1999 |
| GB | 2 225 634 | A | 6/1990 |
| GB | 2 306 221 | A | 4/1997 |
| JP | 5033224 | A | 2/1993 |
| JP | 9195138 | A | 7/1997 |
| WO | WO-9818985 | | 5/1998 |

OTHER PUBLICATIONS

French Patent Office Preliminary Search Report and Written Opinion dated Dec. 16, 2008, issued in a corresponding French Patent Application No. 651851, counterpart to related U.S. Appl. No. 11/434,177, along with its corresponding English language translation.

United Kingdom Search Report dated Oct. 3, 2006 issued in GB Application No. 0609693.7, counterpart to related U.S. Appl. No. 11/434,177.

German Search Report issued in connection with German Application DE 10 2005 023 992.7, counterpart to related U.S. Appl. No. 11/434,177, with an English translation thereof.

U.S. Office Action dated Sep. 18, 2009 for related U S. Appl. No. 11/434,177.

* cited by examiner

Fig. 2a
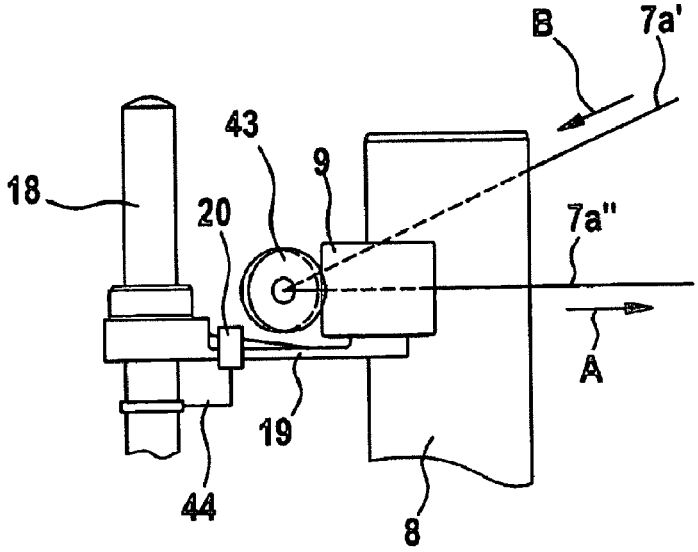
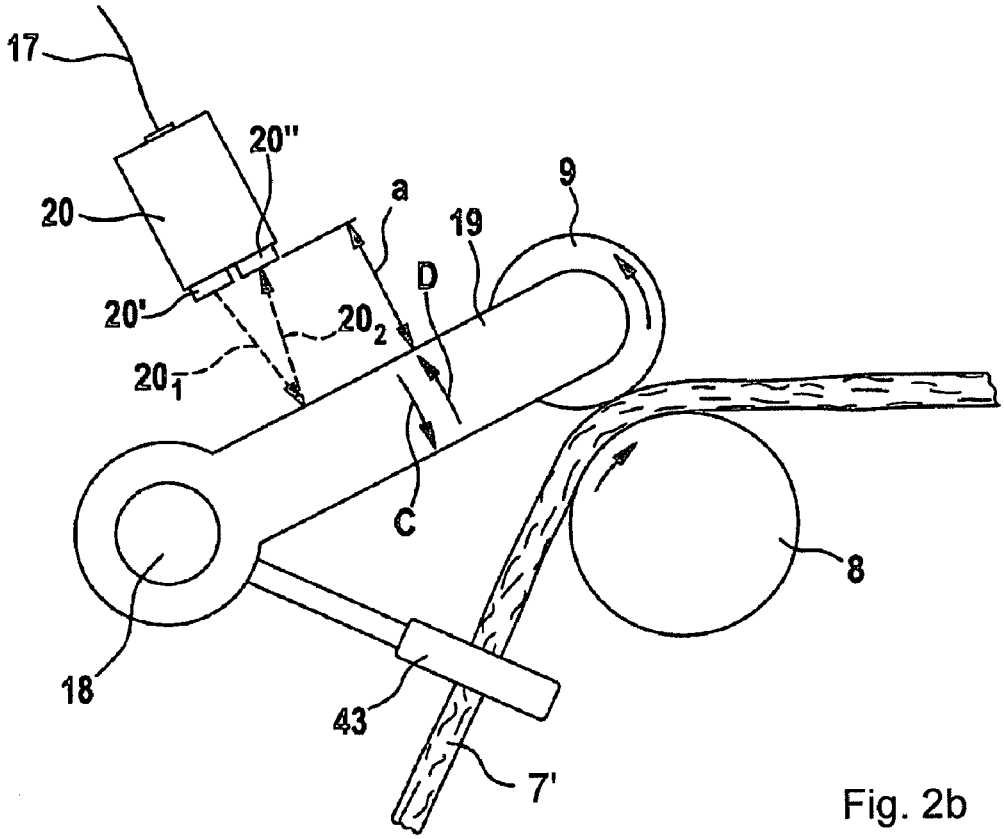
Fig. 2b

APPARATUS FOR DETECTING A PARAMETER AT A PLURALITY OF SLIVERS FED TO A DRAFTING SYSTEM OF A SPINNING MACHINE

CROSS REFERENCE TO RELATED APPLICATION

This application claims priority from German Patent Application No. 10 2005 033 180.7 dated Jul. 13, 2005, the entire disclosure of which is incorporated herein by reference.

BACKGROUND OF THE INVENTION

The invention relates to an apparatus for detecting a parameter at a plurality of slivers fed to a drafting system of a spinning machine, especially for detecting the movement and/or the presence of a sliver.

In a known form of apparatus, the parameter is measurable separately at each sliver, each sliver being drawn out of sliver cans over a respective driven supply roller and fed to the drafting system and being mechanically sensed by a feeler element, the deflections of which are convertible into electrical signals and which feeler element has a sensor element associated with it.

In the case of an apparatus described in WO 98/18985 A, guide rollers as well as eight measuring elements and eight cans for eight slivers are provided—looking upstream from a drafting system. Leads connect all measuring elements in parallel to a computer. The measuring elements each comprise a driven roller and a follower roll, which is mounted on a lever displaceable about an axis of rotation. The roller has a groove for the sliver, which groove can also be engaged by the roll for sensing the sliver. Each sliver entering the drawing system is sensed beforehand in a measuring element to detect a parameter. Possible parameters are preferably the weight, the thickness, the mass etc, in the form of absolute values or relative values, such as the changes in weight, thickness or mass. In this process, the roll is deflected by the volume occupied by the sliver on the roller, which is converted to an output signal proportional to this deflection. The output signals of all measuring elements are fed to the computer via the leads. Each measured value can be compared with a threshold value to ensure that a sliver is actually present, or that the sliver has reached a minimum volume. This dynamics of this mechanical feeling system of tongue and groove roller are not satisfactory at high delivery speeds. The feeler roller may be caused to oscillate owing to the large mass.

It is an aim of the invention to produce an apparatus of the kind described in the introduction that avoids or mitigates the said disadvantages, in particular is of simple structure and allows an improved and more accurate detection of the individual slivers.

SUMMARY OF THE INVENTION

The invention provides an apparatus for detecting a parameter relating to a plurality of fibre slivers that are being fed to a drafting system of a spinning machine comprising at least one sliver feed device comprising a driven supply roller, and a feeler element in which sliver emerging from a sliver supply is transported over said driven supply roller and is mechanically sensed by said feeler element; and a sensor device associated with the or each said feeler element;

wherein the sensor device comprises a contactless distance sensor for detecting the position of a said feeler element, the sensor being connected to an electrical evaluation device.

The contactless distance sensor (sensor measuring distance) according to the invention allows an improved and more accurate detection of the individual slivers in a structurally simple manner. In a preferred arrangement, the feeler element is a pressure roll that cooperates with a feed roller. Advantageously, the measuring point of the optical distance sensor is located on the pressure roll arm, which is, for example, movably mounted. On initial start up (machine at standstill) the pressure roll is placed on the feed roller with no sliver, the distance to the pressure roll is measured and stored in a control unit. With the machine at a standstill the sliver is then placed between the pressure roll and feed roller. The thickness of the sliver reduces the distance between the distance sensor and pressure roll, and the control unit detects a constantly present signal. This signal is compared with the value at initial start up, and it is established that a stationary sliver is present. This measurement with a sliver present ought always to be effected automatically before the machine is switched on, in order to ensure that a sliver is present or that an exchanged sliver is recognised. Due to the transport of the sliver (machine running), the pressure roll is now caused to oscillate permanently, the distance alteration resulting therefrom is detected, a continuously modifiable signal is measured and the control unit detects that a moving sliver is present. If a sliver tears, the pressure roll runs without a sliver on the feed roller, the measured signal is compared with the signal at start up, the measured value at start up is detected and by combining it with the function "machine running", the control unit recognizes that the machine is running with no sliver present. In all the described states in which, by combining signals, the control unit detects that the machine is "not ready for operation", the machine goes to malfunction and switches off. By measuring these different signals, which are evaluated in combination with the function of the machine by programming techniques, it is possible to achieve efficient monitoring of individual slivers at a roller inlet on the basis of the accurate indirect optical/ultrasound distance measurement. The respective individual values of the sliver calibrations can be further processed by programming (e.g. using statistics, alterable measurement parameters of the sliver monitoring etc.).

Advantageously, the distance sensor is a sensor that measures distance using waves or rays. The distance sensor may be an optical or acoustic distance-measuring sensor. The sensor may be an ultrasound distance sensor (distance-measuring sensor). Advantageously, the light ray or sound ray is focussed. The distance sensor may be a light scanner. Preferably, the distance sensor comprises a transmitter and a receiver. The distance sensor may be a laser scanner. The distance sensor may use visible light or may use infrared light. The distance sensor may determine the distances to the feeler element. The distance sensor may determine the distance to a counter-element associated with the feeler element. In one embodiment, the distance sensor is fixed and the counter-element is movable relative to the distance sensor. In another embodiment, the distance sensor is movable and the counter-element is fixed relative to the distance sensor. The counter-element may have a flat scanning surface. The counter-element may have a smooth scanning surface. The counter-element may have a curved scanning surface. The scanning surface is advantageously reflective. Advantageously, the evaluating unit is connected to an electronic open-loop and closed-loop control device. The distance sensor may be an analog sensor. Where appropriate, the signals are advantageously conducted from the measuring point to the evaluating unit using an optical waveguide. Advantageously, the distance sensor scans the excursions of a movable feeler tongue. Advantageously, the distance sensor scans the excursions of a movable feeler roller. Advantageously, the distance sensor scans the excursions of the feeler tongue or the feeler roller directly or indirectly. The apparatus may be used for ascertaining and displaying sliver breakage. Advantageously, the feeler element is mounted on a fixed pivot bearing. The apparatus may be used to determine the parameters of an elongate, substantially untwisted fibre bundle. The distance sensor may be used to measure the parameters with a continuously moving fibre bundle. Advantageously, the determined values for the sliver mass are used to adjust sliver mass fluctuations of the fibre bundle by controlling at least one drafting element of a spinning preparation machine in which the fibre bundle is being drawn. The apparatus may be used for ascertaining and displaying movement. Advantageously, the feeler element is a pivotally mounted lever. Advantageously, the feeler element co-operates with a force-applying element, for example, a counter-weight, spring or the like. Advantageously, the feeler element is mounted so as to be movable in the horizontal direction. Advantageously, the feeler element is resiliently mounted at one end. Advantageously, the feeler element is mounted on a holding member, for example, a lever. Advantageously, the feeler element is mounted so as to be pivotable about a vertical axis. Preferably, the bias of the movably mounted feeler element is effected by mechanical, electrical, hydraulic or pneumatic means, for example, springs, weights, natural resilience, loading cylinders, magnets or the like, and can be adjustable. Advantageously, there is a plurality of distance sensors, each of which scans the thickness of a sliver with a feeler element (individual sliver scanning). Advantageously, the slivers are drawn out of spinning cans over a plurality of driven feed rollers at an input part and are conveyed to a driven drafting system. Advantageously, the feed rollers are fixed. Advantageously, a movable (deflectable) co-rotating roller lies on each feed roller. Advantageously, the movable roller is mounted on rotary bearings by way of rotary levers. Advantageously, the distance sensors are able to detect the deflections of the movable roller and/or at least one rotary lever. Advantageously, the feeler element with the distance sensors is provided at the output of the cans. Advantageously, the feeler elements with the distance sensors form part of an arrangement for removing sliver from the can. Advantageously, the co-rotating roller (pressure point) lies under its own weight on the feed roller. Advantageously, the evaluating device comprises a multi-channel evaluating device. Advantageously, each distance sensor is arranged to be switched off individually. Advantageously, there is a roller nip between the two cylindrical peripheral surfaces of the feed roller and the co-rotating roller (pressure roll). Advantageously, when conveying the fibre bundle the pressure roll oscillates permanently.

The invention also provides an apparatus for detecting a parameter at a plurality of slivers fed to a drafting system of a spinning machine, especially for detecting the movement and/or the presence of a sliver, in which the parameter is measurable separately at each sliver, each sliver being drawn out of sliver cans over a respective driven supply roller and fed to the drafting system and being mechanically sensed by a feeler element, the deflections of which are convertible into electrical signals and which feeler element has a sensor element associated with it, wherein a contactless distance sensor (distance-measuring sensor) is provided to detect the position of each feeler element, which sensor is connected to an electrical evaluating unit.

BRIEF DESCRIPTION OF THE DRAWINGS

FIG. 2*a* is a plan view of a diverting arrangement for diversion of a sliver by a sliver guide between a feed roller and a top roller with a light scanner;

FIG. 2*b* is a side view of the arrangement of FIG. 2*a;*

DETAILED DESCRIPTION OF CERTAIN PREFERRED EMBODIMENTS

Figure 1A:
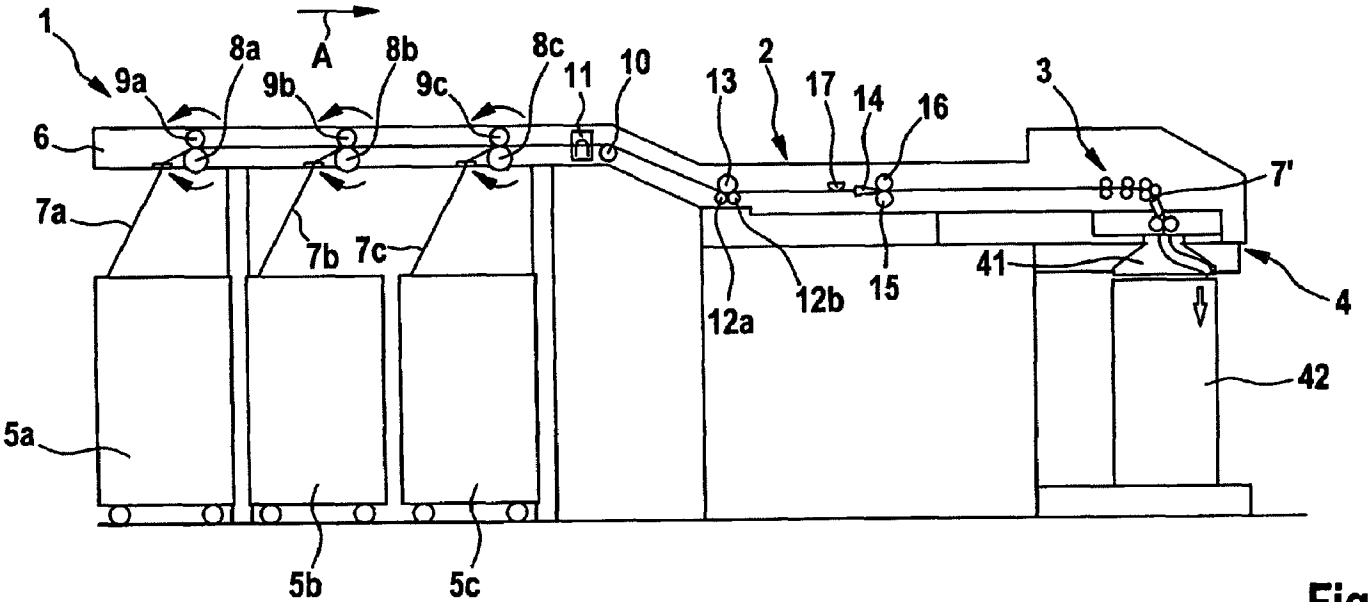
FIG. 1*a* is a schematic side view of a feed table of a draw frame with an apparatus according to the invention.

The side view according to FIG. 1*a* shows the input region 1, the feed region 2, the drafting system 3 and the sliver coiling region 4 of a draw frame, e.g. a draw frame TD 03 (Trade Mark) of Trutzschler GmbH & Co. KG of Monchengladbach, Germany. In the input region 1 three spinning cans 5*a* to 5*c* (round cans) of a draw frame with two rows of cans (see FIG. 1*b*) are arranged beneath the sliver guide plate (creel), and the feed slivers 7*a* to 7*c* are drawn off over feed rollers 8*a* to 8*c* and supplied to the draw frame 3. A co-rotating top roller 9*a* to 9*c* is associated with a respective driven feed roller 8*a* to 8*c*. In the feed table region there are six roller pairs 8*a*, 9*a*; 8*b*, 9*b*; 8*c*, 9*c* (cf.FIG. 1*b*), each comprising a top roller and a feed roller. Slivers 7*a* to 7*c* are lifted from the spinning cans 5*a* to 5*c* and are guided on the feed table 6 to the drafting system 3. After passing through the drafting system 3, the drawn sliver 7' enters a revolving plate of a can coiler and is laid in coils in the delivery can. The feed table 6 extends right up to the draw frame across the region of the sliver feed device as a whole. Via the sliver feed device a sliver 7*a*-7*c* is supplied from each spinning can 5 to the draw frame. Feed is effected through a respective sliver feed point, each of which comprises a roller pair 8*a*, 9*a*; 8*b*, 9*b*; 8*c*, 9*c* (roller inlet). In the region of each lower roller 8*a* to 8*c*, a respective guide element is provided for guiding the slivers 7*a*-7*c*. The letter A denotes the running direction of the slivers 7*a*, 7*b* and 7*c*. The slivers 7*a* to 7*c* are squeezed between the roller pairs 8*a*, 9*a*; 8*b*, 9*b*; 8*c*, 9*c*. The direction of rotation of the feed rollers 8*a* to 8*c* and the top rollers 9*a* to 9*c* is indicated by curved arrows. Each feed roller 8*a*-8*c* is connected to a drive means. At the output of the feed table 6 there is a guide device for the slivers 7*a* to 7*f*, (see FIG.1*b*), comprising a horizontal bar 10 of cylindrical cross-section, affixed to the rear of which are eight cylinders 11. The axes of the cylinders 11 are vertically aligned and the spacing between the cylinder casings of the cylinders 11 is large enough for a respective sliver 7*a* to 7*f* to pass through without hindrance. By this means, guide grooves open at the top are formed for the slivers 7*a* to 7*f*, that is, the cylinders 11 function as guide elements. Following the feed table 6 there is a driven roller arrangement, for example, two jockey bottom rollers 12*a*, 12*b* and one jockey top roller 13, at the input to the draw frame.

Figure 1B:
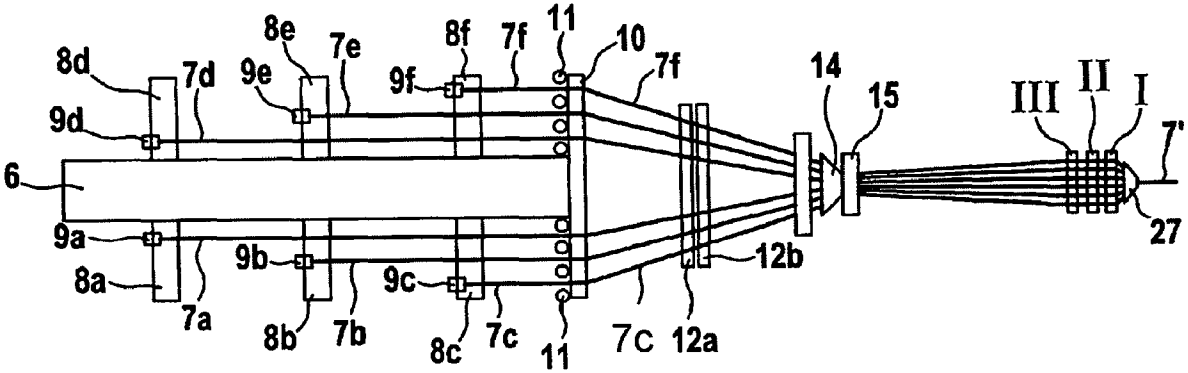
FIG. 1*b* is a plan view of the apparatus of FIG. 1*a;*

As shown in FIG. 1*b*, on each side of the feed table 6 a row of three spinning cans 5*a*-5*c* (not shown) is set up parallel to one another. In operation, a sliver 7*a*-7*f* can be drawn from each of the six spinning cans at the same time. Alternatively, the mode of operation can be such that sliver 7*a*-7*f* is drawn off on one side only, for example, from the three spinning cans 5*a* to 5*c*, whilst on the other side the three spinning cans (not shown) are being exchanged. Furthermore, on each side of the feed table 6 there are three feed rollers 8*a*, 8*b*, 8*c* respectively 8*d*, 8*e*, 8*f* arranged in succession in the working direction A. Two feed rollers 8*a*, 8*d*; 8*b*, 8*e*; 8*c*; 8*f* respectively are arranged coaxially with one another. The feed rollers 8*a* to 8*f* have the same diameter, e.g. 100 mm. The speeds of rotation n (not shown) of the feed rollers 8*a* to 8*f* decrease in the working direction A, i.e. $n_1>n_2>n_3$. The circumferential speeds U (not shown) of the feed rollers 8*a* to 8*f* thus decrease in the working direction. It is thus possible to adjust the circumferential speeds U.sub.1, U.sub.2, U.sub.3 of the feed rollers 8*a* to 8*f* individually, so that the input tension of all slivers 7*a*-7*f* can be achieved in the desired manner. The drive of the feed rollers 8*a* to 8*f* can be achieved by way of gear mechanisms (not shown) or similar transmission devices. The variable speed motor 31 (see FIG. 3*b*) that transfers drive power to the feed rollers 8*a* to 8*f* via belts (not shown) is used for the drive. The feed rollers 8*a* to 8*f* are each (in a manner known per se) of two-part construction and are of different lengths in relation to one another. The length of the slivers 7*a*-7*f* in the input region 1 decreases from the inside outwards. According to FIG. 1*a*, FIG. 1*b*, the slivers 7*a* to 7*f* run from the feed table 6 of the input region 1 via the guide device (rod 10, cylinders 11 ) through the jockey roller arrangement 12*a*, 12*b* 13, the sliver guide 14 (including measuring device) with the transport rollers 15 and 16, through the drafting system 3, the web guide 27, the sliver funnel 30 with the delivery rollers 28, 29 (see FIG. 3*b*) and the revolving plate 41 into the can 42.

FIG. 1*b* illustrates the rollers 8*a* to 8*f*, 12*a*, 12*b*, 15, III, II and I, all arranged underneath the slivers 7*a*-7*f*. According to FIG. 1*b*, the fibre bundle comprising six slivers 7*a*-7*f* in the region between the roller pairs 8*a* to 8*f*, 9*a*-9*f* and the jockey roller arrangement 12*a*, 12*b*, 13 is subject to an input creel tension, the jockey comprising six slivers 7*a*-7*f* in the region between the jockey roller arrangement 12*a*, 12*b*, 13 and the transport rollers 15, 16 is subject to a jockey roller tension and the fibre bundle comprising six slivers 7*a*-7*f* in the region between the transport rollers 15, 16 and the feed rollers 26, III of the drafting system 3 is subject to a transport roller tension.

Referring to FIG. 2*a*, a sliver 7*a*', for example, is drawn out of the can 5*a* (not shown)in direction B, passes through the opening of the sliver guide 43 (thread eyelet), in so doing is diverted in direction A and finally passes in the form of a sliver 7*a*" through the roller nip between the driven feed roller 8 and the co-rotating top roller 9. The top roller 9 is rotatably secured to one end of a rotatable weighting lever 19. The other end of the weighting lever 19 is secured to a stationary stay bar 18, which is mounted on the sliver feed table 6. The weighting lever 19 is rotatable in the direction of arrows C, D (see FIG. 2*b*). A light scanner 20, which is fixedly secured to the stay bar 18 via a holding element 44, is provided above the weighting lever 19 as the distance sensor.

According to FIG. 2*b*, the distance sensor 20 (light sensor) consists of a phototransmitter 20' and a photoreceiver 20". The light beam $\mathbf{20}_1$, emitted by the phototransmitter 20' is reflected by the smooth surface of the weighting lever 19 and the reflected light beam $\mathbf{20}_2$ is received by the photoreceiver 20". The reference numeral 17 denotes an electrical lead, via which the distance sensor 20 is in connection with an evaluating unit (see electronic control and regulating device 38 in FIG. 3*b*). The letter a denotes the distance between the phototransmitter 20' and the photoreceiver 20", on the one side and the weighting lever 19 on the other side.

Figure 3A:
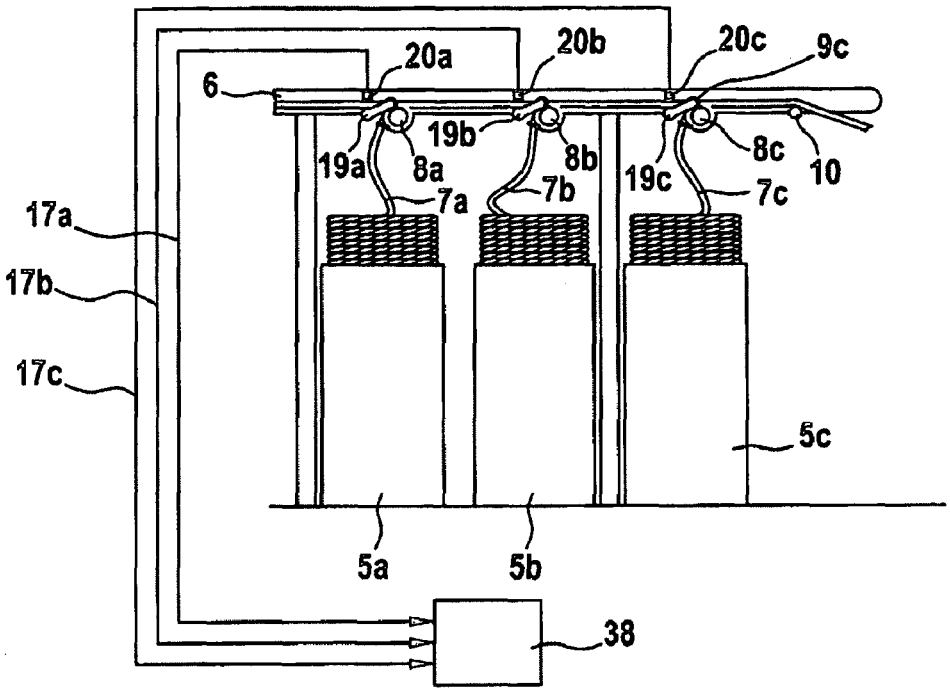
FIG. 3*a* is a side view of a feed table of a draw frame with three pairs of feed and top rollers, a respective light scanner being associated with weighting levers.

According to FIG. 3*a*, each weighting lever 19*a*, 19*b*, 19*c* has associated with it a respective light scanner 20*a*, 20*b*, 20*c*. The light scanners 20*a*, 20*b* and 20*c* are connected via respective lines 17*a*, 17*b*, 17*c* to the control and regulating device 38 (see FIG. 3*b*), which acts as an electronic evaluating means. The leads 17*a*, 17*b*, 17*c* transmit electrical pulses.

The leads 17*a*, 17*b*, 17*c* can be in the form of fibre optic cables. A signal converter (not shown) that converts the light pulses into electrical pulses then has to be arranged between the light scanners 19*a*-19*c* and the open-loop and closed-loop control device 38.

Figure 3B:
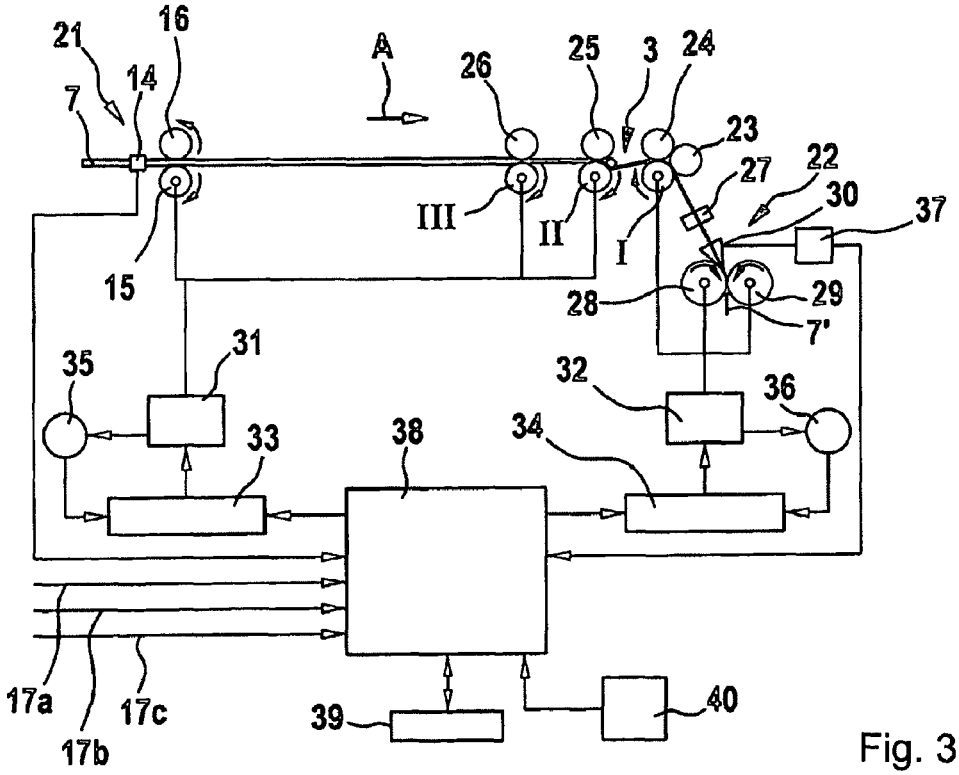
FIG. 3*b* is a schematic side view of a draw frame with a block diagram of an electronic open-loop and closed-loop control device for the draw frame.

According to FIG. 3*b*, the draw frame comprises the drafting system 3, upstream of which a drafting system inlet 21 is arranged and downstream of which a drafting system outlet 22 is arranged. The slivers 7, drawn by the take-off rollers 15, 16, are transported past the sliver guide and measuring element 14. The drafting system 3 is designed as a 4-over-3 drafting system, that is, it consists of three bottom rollers I, II, III (I being the bottom delivery roller, II being the middle bottom roller and III being the bottom feed roller) and four top rollers 23, 24, 25, 26. Drafting of the fibre bundle 7 comprising several slivers 7*a* to 7*f* takes place in the drafting system 3. The draft is made up of the preliminary draft and the main draft. The roller pairs 26/III and 25/II form the preliminary draft zone and the roller pairs 25/II and 23,24/I form the main draft zone. The drawn slivers 7 reach a web guide 27 at the drafting system outlet 22 and are drawn by means of the delivery rollers 28, 29 through a sliver funnel 30, in which they are condensed to a sliver 7', which is subsequently laid in the can 42 (see FIG. 1*a*). The take-off rollers 15, 16, the bottom feed roller III and the middle bottom roller II, which are mechanically coupled via toothed belts, are driven by the variable speed motor 31, wherein a desired value can be preset. (The associate top rollers 26 and 25 co-rotate). The bottom delivery roller I and the delivery rollers 28, 29 are driven by the main motor 32. The variable speed motor 31 and the main motor 32 each have their own closed loop system, 33, 34, respectively. The control (speed control) is elected by a closed-control loop, a tachogenerator 35 being associated with the variable speed motor, and a tachogenerator 36 being associated with the main motor 32. At the outlet 22 to the drafting system, a variable proportional to the mass, for example, the cross-section of the emerging sliver 71, is obtained from a delivery measuring element 37 associated with the sliver funnel 30. A central processing unit 38 (open-loop and closed-loop control device), for example, a microcomputer with microprocessor, relays a setting of the desired variable for the variable speed motor 31 to the controller 33. The measured variables of the measurement element 14 are relayed to the central processing unit during the drafting operation. The manipulated value for the variable speed motor 31 is determined in the central processing unit 38 from the measured variables of the measurement element 14 and from the desired value for the cross-section of the emerging sliver 7'. The measured variables of the delivery measurement element 37 serve to monitor the emerging sliver 7' (output sliver monitoring). Using this control system, fluctuations in the cross-section of the slivers 7 fed in can be compensated by corresponding regulations of the preliminary drafting process and the sliver 7' can be evened out. The reference number 39 denotes an input device and the reference number 40 denotes a display means, for example a visual display unit or similar. 17*a*, 17*b*, 17*c* denote the leads that connect the light scanners 20*a*, 20*b*, 20*c* respectively to the processing unit 38 (evaluating unit), as shown in FIG. 3*a*.

FIG. 3*b* has been described using the example of an autoleveller. A non-regulated draw frame is also included.

The sliver 7 (a maximum of 8) is drawn out of the can 5 over the feed creel 6 through the draw frame attached thereto. The roller creel principally comprises two supports and a beam. Feed rollers are mounted on this beam by means of stay bars 18 and pressure rolls 9. The feed rollers 8 are driven by the draw frame. A sliver guide 43 and a stay bar 18 with pressure roll 9 are mounted at the feed rollers. To stabilise it, the sliver 7 is first guided through the sliver guide 43 and then over the driven feed roller 8 towards the draw frame. The sliver 7 can only be transported by the feed roller 8 when the pressure roll 9, which is connected to the stay bar 18 via a movable arm 19, lies on the sliver 7 and, by virtue of its relatively large dead weight, presses the sliver 7 onto the feed roller 8. The sliver 7 is thus pressed to a certain degree between the feed roller 8 and the pressure roll 9. So that the sliver 7 can be moved without sustaining damage, the pressure roll 9 is rotatably mounted.

By mounting a distance sensor, for example, an optical distance sensor 20 (optionally with fibre optic cable), on the stay bar 18 that is present with pressure roll 9, it is possible to carry out a distance measurement to the pressure roll 9 and to detect consequential states of the sliver. The advantage is that a completely mechanically dissociated, contactless individual monitoring of the individual slivers takes place. The operating states described below arise from the program linkage between distance measurement and operating state of the machine.

Pressure roll present
Sliver present, sliver stationary, machine at standstill
Sliver present, sliver stationary, machine running
Sliver present, sliver moving, machine at standstill
Sliver present, sliver moving, machine running
Sliver absent, machine at standstill
Sliver absent, machine running.

The sequence of this evaluation unfolds as follows:

The optical distance sensor 20 has its measuring point on the arm 19 of the pressure roll 9, this arm being, for example, movably mounted. At initial commissioning (machine at standstill), the pressure roll 9 is placed on the feed roller 8 with no sliver 7, the distance to the pressure roll 9 is measured and stored in a control unit 38. With the machine at a standstill the sliver 7 can then be placed between the pressure roll 9 and feed roller 8. The thickness of the sliver 7 reduces the distance between the distance sensor 20 and pressure roll 9, and the control unit 38 detects a constantly present signal; this signal is compared with the value at initial start up, and a stationary existing sliver 7 is detected. This measurement with a sliver 7 present ought always to be effected automatically before the machine is switched on, in order to ensure that a sliver 7 is present or that an exchanged sliver 7 has been recognised. Owing to the transport of the sliver 7 (machine running), the pressure roll 9 is now caused to oscillate permanently, the variation in distance resulting therefrom is detected, a continuously alterable signal is measured and the control unit 38 detects that a sliver 7 is present and is moving. If the sliver 7 tears, the pressure roll 9 runs without a sliver 7 on the feed roller, the measured signal is compared with the signal at start up, the measured value at start up is detected and by combining it with the function "machine running", the control unit 38 recognizes that the machine is running with no sliver present. In all the described states in which, by combining signals, the control unit 38 detects that the machine is "not ready for operation", the machine goes to malfunction and switches off. By measuring these different signals, which are evaluated in combination with the function of the machine by programming techniques, it is possible to achieve efficient monitoring of individual slivers at a roller inlet on the basis of the accurate indirect optical distance measurement. The respective individual values of the sliver calibrations can be further processed by programming (e.g. using statistics, alterable measurement parameters of the sliver monitoring etc.). An 8-channel evaluating unit may advantageously be used. Furthermore, it is an advantage to be able to switch off individual sliver monitoring by control engineering methods Although the foregoing invention has been described in detail by way of illustration and example for purposes of understanding, it will be obvious that changes and modifications may be practised within the scope of the appended claims.

What is claimed is:

1. An apparatus for detecting a parameter relating to a plurality of fibre slivers that are being fed to a drafting system of a spinning machine comprising;

at least one sliver feed device comprising a driven supply roller and a feeler element, in which sliver emerging from a slivery supply is transported over said driven supply roller and is mechanically sensed by said feeler element;

a sensor device associated with said feeler element, wherein the sensor device comprises a contactless distance sensor for detecting the position of said feeler element; and an electrical evaluation device connected to the sensor device.

2. An apparatus according to claim 1, in which there is fed to the drafting system a plurality of fibre slivers and there is associated with each sliver a respective feeler element and a respective distance sensor for detecting the position of said respective feeler element.

3. An apparatus according to claim 1, in which the or each distance sensor is an optical or acoustic distance-measuring sensor.

4. An apparatus according to claim 1, in which the at least one sensor is selected from ultrasound distance sensors, light scanners, and laser scanners.

5. An apparatus according to claim 1, in which the or each distance sensor comprises a transmitter and a receiver.

6. An apparatus according to claim 1, in which the or each distance sensor uses visible or infrared light.

7. An apparatus according to claim 1, in which the or each distance sensor determines the distances to the corresponding feeler element.

8. An apparatus according to claim 7, in which the or each distance sensor is fixed and the or each respective counter-element is movable relative to the distance sensor.

9. An apparatus according to claim 7, in which the or each distance sensor is movable and the or each respective counter-element is fixed relative to the distance sensor.

10. An apparatus according to claim 7, in which the feeler element or counter-element has a scanning surface, which is reflective.

11. An apparatus according to claim 1, in which the evaluating unit is connected to an electronic open-loop and closed-loop control device.

12. An apparatus according to claim 1, in which the signals are conducted from the measuring point to the evaluating unit using an optical waveguide.

13. An apparatus according to claim 1, in which the feeler element is a movable feeler tongue.

14. An apparatus according to claim 1, in which the feeler element is a movable feeler roller.

15. An apparatus according to claim 1, which is suitable for determining one or more parameters of an elongate, substantially untwisted fibre bundle.

16. An apparatus according to claim 1, which is suitable for measuring one or more parameters of a continuously moving fibre bundle.

17. An apparatus according to claim 1, in which determined values for the sliver mass are used to adjust sliver mass fluctuations of the fibre bundle by controlling at least one drafting element of a spinning preparation machine in which the fibre bundle is being drawn.

18. An apparatus according to claim 1, in which the feeler element is pivotably mounted.

19. An apparatus according to claim 1, in which a plurality of slivers are drawn out of spinning cans over a plurality of driven feed rollers at an input region of a driven drafting system and are conveyed to the drafting system.

20. An apparatus according to claim 19, in which the distance sensors are able to detect the excursions of the movable roller.

21. An apparatus according to claim 1, in which a plurality of feeler elements with respective distance sensors form part of an arrangement for removing sliver from the cans.

22. An apparatus according to claim 1, in which each distance sensor is arranged to be switched off individually.

23. An apparatus according to claim 1, in which the parameter is a parameter related to mass.

24. An apparatus according to claim 1, in which the parameter is mass or thickness.

25. An intake apparatus for intake of a plurality of fibre slivers to a drafting system of a spinning room machine, comprising first and second sliver feed devices, each of said sliver feed devices being arranged to transport a respective sliver emerging from a sliver supply source, wherein each sliver feed device comprises a feeler element for mechanically sensing the respective sliver and a contactless distance sensor for detecting the position of the respective feeler element.

* * * * *